US006937204B2

(12) United States Patent
Hall

(10) Patent No.: US 6,937,204 B2
(45) Date of Patent: Aug. 30, 2005

(54) PLATE DIPOLE ANTENNA

(75) Inventor: Gregory Daniel Hall, Porirua (NZ)

(73) Assignee: Aerial Science Limited, Wellington (NZ)

( * ) Notice: Subject to any disclaimer, the term of this patent is extended or adjusted under 35 U.S.C. 154(b) by 69 days.

(21) Appl. No.: 10/474,615

(22) PCT Filed: Apr. 12, 2001

(86) PCT No.: PCT/NZ01/00063

§ 371 (c)(1),
(2), (4) Date: Oct. 14, 2003

(87) PCT Pub. No.: WO01/80364

PCT Pub. Date: Oct. 25, 2001

(65) Prior Publication Data

US 2004/0212543 A1 Oct. 28, 2004

(51) Int. Cl.[7] ..... H01Q 9/28

(52) U.S. Cl. ..... 343/795; 343/821

(58) Field of Search ..... 343/700 MS, 793, 343/795, 803, 806, 810, 812, 820, 821, 797

(56) References Cited

U.S. PATENT DOCUMENTS 5,130,711 A * 7/1992 Kimura et al. ..... 342/22
5,173,715 A * 12/1992 Rodal et al. ..... 343/795
6,163,306 A * 12/2000 Nakamura et al. ..... 343/797
6,281,857 B1 * 8/2001 Dobrovolny ..... 343/795
6,600,454 B1 * 7/2003 Moilanen ..... 343/795

* cited by examiner

*Primary Examiner*—Hoang V. Nguyen

(57) ABSTRACT

A plate dipole antenna includes a pair of plates arranged in substantially the same plane or arranged in different planes, with a width to length ratio of one width unit to ten length units or greater. The plate dipole antenna may further include a gain plate.

22 Claims, 3 Drawing Sheets

(Curved)

(Folded)

(Discontinuity)

(Multiple)

(with Balun)

PLATE DIPOLE ANTENNA

FIELD OF INVENTION

The invention relates to dipole antennas and in particular to dipole antennas using plate elements.

BACKGROUND

For most known antenna designs the dipole elements are formed to specific lengths to resonate to specific frequencies. Dipoles are usually made up to suit 50 ohm, 75 ohm or 300 ohm impedances. Key measurements within the dipole are harmonics (eg 1, ½, ⅓, ¼) of specific frequency wavelength(s). A 50 ohm dipole is cut to a ¼ wave with an earth screen and a 75 ohm dipole is a balanced dipole made of two ¼ wave dipoles or a folded dipole with a balun. These dipoles are generally tubular. Such dipoles perform acceptably for frequencies close or harmonically related to the frequencies for which they are designed. However, these dipoles perform less acceptably, if at all, for frequencies that are not harmonically related to the frequencies for which they are designed.

Known broadband dipole designs offer very low gain. These dipoles are consequently unusable in some situations. A low gain dipole requires higher signal strength than high gain antennas to perform as reliably as a higher gain dipole. However known methods to increase the gain of a dipole reduce available bandwidth.

Low dipole gain and narrow dipole bandwidth lead to increases in the size of the resulting antenna assemblies. Larger antennas use more materials and are more expensive to manufacture than smaller antennas. They also have the disadvantages of taking more effort to secure and being more visually obtrusive.

SUMMARY OF INVENTION

It is the object of the present invention to go some way to alleviate the disadvantages described above, or at least provide the public with a useful choice.

In broad terms in one aspect the invention comprises a plate dipole antenna including a pair of plates arranged in substantially the same plane, with a width to length ratio of greater than 1 width unit to 10 length units.

Preferably the separation between the plates is greater than or equal to 10% of the length of one of the plates.

Preferably the plates have a flat surface. Alternatively the plates may have a curved surface or the plate surface may be parabolic or another surface arrangement. The surface may include folds and discontinuities.

A gain plate may be used with the plate dipole antenna to provide greater gain.

The plates of the antenna may be connected to a balun. Preferably when a balun is used with the antenna of the invention each plate of the antenna is electrically connected to a separate balun wire.

In broad terms in another aspect the invention comprises a plate dipole antenna including a pair of plates arranged in different planes with a length to width ratio of at least one width unit to ten length units.

Preferably the smaller of the two angles between the plates in a pair is greater than 90 degrees.

Preferably the plates have a substantially flat surface. Alternatively the plates may have a curved surface or the plate surface may be parabolic or another surface arrangement. The surface may include folds and discontinuities.

A gain plate may be used with the plate dipole antenna to provide greater gain.

The plates of the antenna may be connected to a balun. Preferably when a balun is used with the antenna of the invention each plate of the antenna is electrically connected to a separate balun wire.

For the purposes of this specification a plate is defined as an electrically conducting object providing a major surface area. The plate may be formed from solid material or may have a variety of regular or irregular holes or patterns. A plate can be a mesh or a skeleton The plate may be any shape, including rectangles, ellipses or other shapes. However when the plates are arranged in the same plane this range of shapes excludes substantially triangular shapes where in a pair each triangular shape points an apex approximately towards the centre of the other triangle. A conventional folded dipole formed from elements that are not plates according to the defination herein is expressly excluded from the defination of plate.

For the purposes of this specification the length and width of the plates are determined in a manner which depends on any additions to the plates. If there are no additions to either plate of a pair then the length of each plate is the maximum length of the longest side of the plate and the width is the maximum width of the side of the plate perpendicular to the length. Should the plate length and width measurements be equal not including any dipole additions then either measurement may be chosen as the length provided no dipole additions are attached to the chosen length side.

If there are additions to the plates or the antenna of the invention then the width of the plate is assessed as the maximum width of the plate including any additional dipole, skeleton or other device attached to the plate. The length in this case is assessed as the maximum length measurement of the plate excluding any additional dipole, skeleton or other device attached to the plate.

BRIEF DESCRIPTION OF DRAWINGS

Preferred forms of the invention are described by way of example with reference to the accompanying drawings and without intending to be limiting wherein.

DETAILED DESCRIPTION

Figure 1:
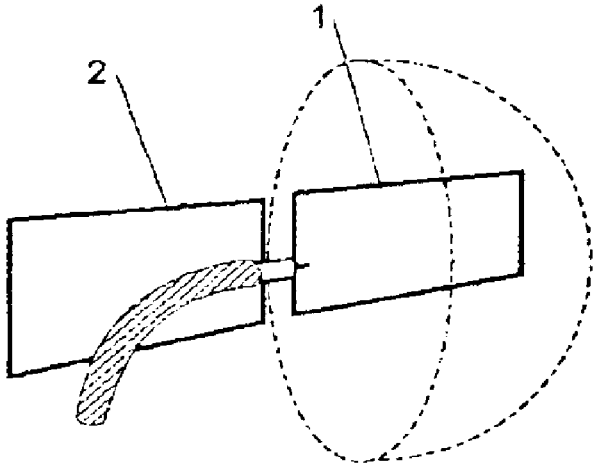
FIG. 1 shows a first embodiment of antenna of the invention.

The antenna of FIG. 1 includes a pair of plates 1, 2 forming a dipole antenna. The plates are connected electrically or inductively to either a cable screen or a core. The plates of the antenna shown in FIG. 1 are rectangular but other shaped plates may be used within the definition of plate given above. The plates of the antenna of the invention are arranged in substantially the same plane.

As shown in FIG. 1 the plates of the antenna have a width to length ratio of greater than 1 to 10 where the longer plate dimension is the length and the shorter plate dimension is the width. Where the plate dimensions are not regular or other dipoles, skeletons etc have been attached to the plates, then different length and width measurements are used. If there are no additions to either plate of the pair then the length is the maximum length of the longest side of the plate and the width is the maximum width of the side of the plate perpendicular to the length. Should the plate length and width measurements be equal not including any dipole additions then either measurement may be chosen as the length provided no dipole additions are attached to the chosen length side.

If there are additions to the plates of the antenna of the invention then the width of the plate is assessed as the maximum width of the plate including any additional dipole, skeleton or other device attached to the plate. The length in this case is assessed as the maximum length measurement of the plate excluding any additional dipole, skeleton or other device attached to the plate.

The plates may be flat or alternatively may be curved, folded or bent. Curvature on the plates is not restricted to even curvature. It is preferred that any deviation from flat in the plates is equal to less than 40% of the length of the plate, where the plate length is as defined above. The two plates are not restricted to the same shape or size and combination of different shapes and sizes of plate may be used.

As shown in FIG. 1 the plates are preferably separated by a distance of at least 10% of the length of one of the plates.

The plates of the antenna of the invention may be constructed from a solid material or may have a variety of regular or irregular holes or patterns. The plate surface area, real or virtual, determines the frequencies which the plate receives.

The plates of the antenna may be formed to suit two separate frequencies. Two dissimilar plates may be combined into a single pair. Alternatively dissimilar pairs of plates may be combined within a single dipole. Plate dipoles may also be combined with non-plate dipoles, which may include folded or other dipoles that form a connection between separate plates. For example a common dipole could be attached to a plate dipole of the invention.

The pairs of plate dipoles of the invention may be used in combination with other dipoles either plate dipoles or non-plate dipoles to produce a multi-head antenna. In this form of antenna the plates may have a dual use as reflectors and as a separate dipole head. For example the plates could be used for receiving TV frequencies and act as a reflector for satellite microwave frequencies. When more than one pair of dipoles is used the plates of at least one pair should be arranged in substantially the same plane but other pairs of plates may be arranged in different planes to each other and to the pair in the same plane.

This embodiment of the invention bears some resemblance to a common 75 ohm dipole. However the minimum plate width, minimum separation of plates, plate surface area and variable impedance all serve to distinguish the antennas of the invention from the common 75 ohm dipole. The length of the common dipole is determined by harmonic resonant frequencies which is not the case of the plate dipole of the invention. The plate dipole of the invention has the advantages of being broadband and having a better gain performance than the common dipole. In general a plate dipole antenna of the invention with the same gain as a common dipole will be smaller than the common dipole and have greater bandwidth.

Another type of dipole antenna is the bowtie dipole. These antennas include two substantially triangular bowtie pieces that meet in the middle at the points of the bowtie. The bowtie dipole is generally a skeleton but may be solid. The plate antennas of the invention may be distinguished from the bowtie because the antennas of the invention define a surface area where the design principles for a bowtie dipole outline a resonant circuit. The bowtie dipole also does not have the gain or bandwidth of this instance of a plate dipole antenna of the invention.

Figure 2:
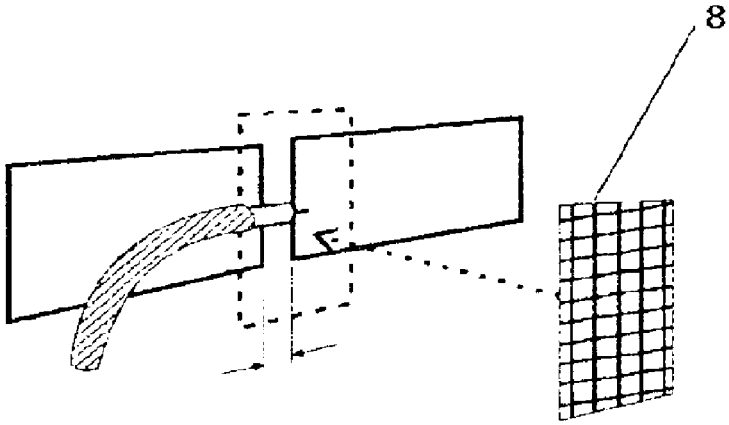
FIG. 2 shows the first embodiment of antenna of the invention with a gain plate.

Gain plates are used to increase the gain of the antenna. Gain plates are generally arranged in front of the dipole. However in conventional dipole antennas the use of gain devices, while increasing the gain of the antenna, reduce the bandwidth of the antenna FIG. 2 shows the antenna of FIG. 1 arranged in combination with a gain plate 8. The gain plate may have the same shape as the plates of the antenna of the invention or may be any other suitable shape. Like the plates of the invention the gain plate may be constructed from a solid material or may have a variety of regular or irregular holes or patterns.

The gain plate also has a width to length ratio of at least 1 to 10 and preferably greater than 1 to 10. The gain plate is not electrically connected to the plate dipole antenna. The gain plate or plates 8 are arranged in front of the plate dipole antenna as shown in FIG. 2. When more than one gain plate is used the plates may be connected together but this is not essential. These gain plates provide gain to the antenna while not reducing the bandwidth of the antenna. The gain plates may be used in combination with known gain devices.

Figure 3:
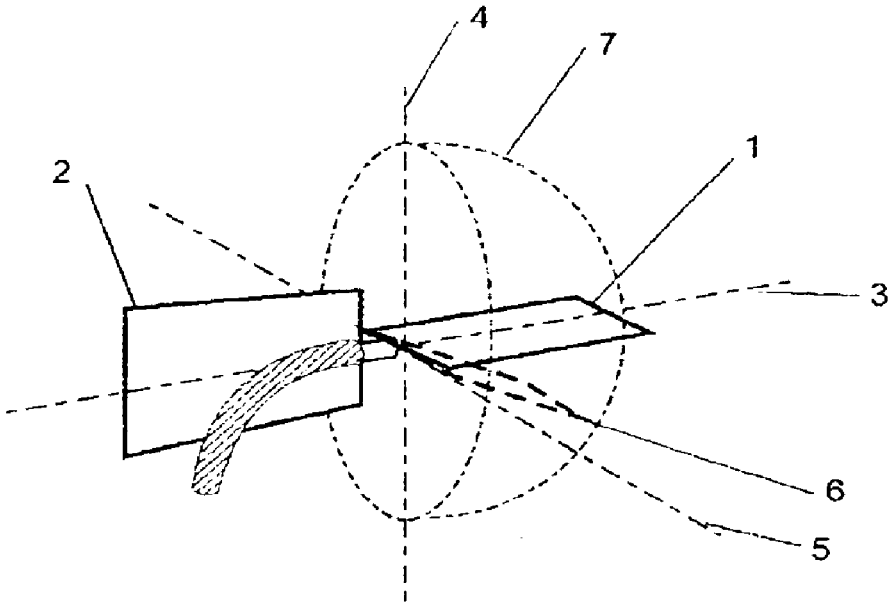
FIG. 3 shows a second embodiment of antenna of the invention.

FIG. 3 shows a second embodiment of antenna of the invention. In this embodiment the plates of the antenna are not in the same plane. Here plate 2 is in the same plane as the plates of the antenna of FIG. 1 but plate 1 has been rotated by 90 degrees to be perpendicular to plate 2. Rotation of the plates produces different impedances on the antenna. For example if the antenna of FIG. 1 has about a 75 ohm impedance antenna the antenna of FIG. 3 may have 50 ohm impedance. The plates may be rotated with respect to each other either axially around an axis 3 running through the centre of the plates when in the same plane or axially around axes 4 and 5 between the plates. A second possible position of the plate 1 is shown at dotted outline 6. The orientation of one plate to the other preferably falls within the half-sphere 7 shown in FIG. 3.

The pair of plates of the plate dipole antenna have two angles between them. For the antennas described with reference to FIG. 1 these angles are both about 180 degrees. For the antennas described with reference to FIG. 3 these angles may range between 90 degrees and 270 degrees.

It has been found for a pair of plates arranged in substantially the same plane and having about a 75 ohm impedance, that one of the plates can be rotated 90 degrees relative to the other to produce a plate dipole antenna with about 50 ohm impedance. This antenna has been found to be useful and have high gain and be broadband like the 75 ohm antenna Other orientations of the plates of the antenna will produce antennas with different impedances.

The plates may be separated by a distance of greater than 5% of the length of one of the plates. However when the plates are arranged in different planes the separation of the plates does not affect the performance of the antenna Like the antenna described with reference to FIG. 1 the plates of the antenna are not restricted to a matching pair. In this case the plates may be any shape. Where the plates are not of uniform shape or other dipoles, skeletons or other devices are attached to the plates the length and width of the plates are assessed as described above. In this way a meaningful length and width can be assessed for any shaped plate. The width of the plate must be at least one tenth of the length of the plate and preferably greater than one tenth of the length of the plate. Ideally the width of the plates is greater than 50% of the plate length. The plates need not be the same shape and size and plates with different shapes and sizes can be used in combination to form an antenna of the invention. The plates are not restricted to flat plates and may includes curves, folds, discontinuities or other deviations from flat as described above.

Again multiple pairs of plates can be formed into an antenna. The plates in a pair may also have attachments such as dipoles, skeleton or other devices to alter the gain and range of frequencies of the antenna, which may include folded or other dipoles that form a connection between separate plates.

The combination of plate shapes, orientation of the plates with respect to each other and dipole alignment with respect to antenna gain plates, directors and/or reflectors determines signal polarity. Again the frequencies of the antenna are assessed as a function of the surface area of the plates of the antenna.

Each antenna has a specific impedance which should be matched to the impedance of the transmitter/receiver system for optimum performance. One device to match the impedance of an antenna to that of the transmitter/receiver system is a balun. Use of a balun may lead to degraded performance through signal losses. Impedance of the antennas of the invention is assessed as a function of the orientation of the plates of the antenna. The plate dipole antenna may be connected to a balun. However because of the geometrically variable impedance of the antennas of the invention the use of a balun or comparable electronic device is optional. Should such a device be used then each plate of a pair should be electrically or inductively connected to the negative or positive polarity of the device.

Figure 4:
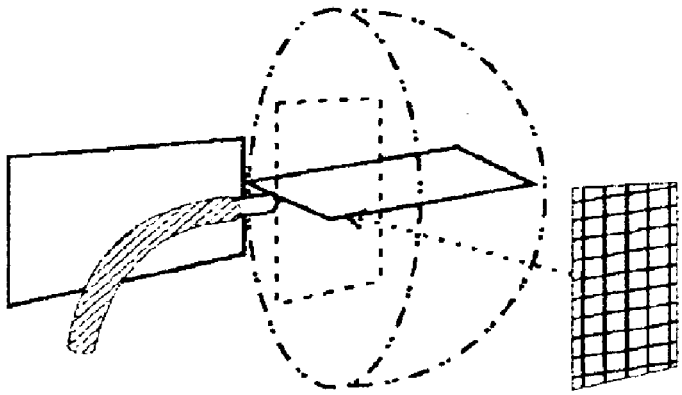
FIG. 4 shows the second embodiment of antenna of the invention with a gain plate.

Again gain plates may be used with the antennas described with reference to FIG. 3. An example of a gain plate in use with a plate dipole antenna where the plates are not in the same plane is shown in FIG. 4. The use of the gain plate increases the gain of the antenna is generally smaller than comparable devices and may be important to the visual effect of the antenna.

Figure 5A:
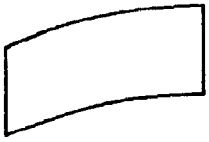
FIG. 5*a* shows a first embodiment of a plate with a curved surface.
Figure 5B:
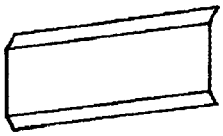
FIG. 5*b* shows a first embodiment of a plate surface including at least one fold.
Figure 5C:
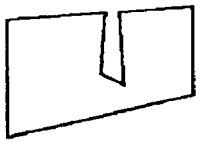
FIG. 5*c* shows a first embodiment of a plate surface with a discontinuity.

The drawings labeled FIGS. 5*a*, 5*b* and 5*c* provide examples of optional variations in plate surface geometry. FIG. 5*a* shows a plate with one curved surface. FIG. 5*b* shows a plate including folds. FIG. 5*c* shows a plate including a discontinuity. Variations of curvature, folds and discontinuities may be advantageously included in an antenna of the invention to alter the impedance, radiation pattern, gain or structural properties of an antenna. In addition, curving or folding a plate may assist with incorporating an antenna within the casing of a product such as a mobile telephone.

Figure 6:
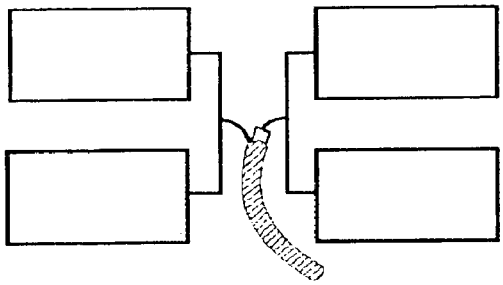
FIG. 6 shows a first embodiment of antenna of the invention with at least one additional pair of plates.

FIG. 6 provides an example antenna of the invention with an additional pair of plates. FIG. 6 illustrates a coaxial lead termination. Opposing plates from each dipole pair are connected to either the cable screen or core. Multiple dipole plates may be used to alter impedance, radiation pattern, gain or bandwidth characteristics of an antenna.

Figure 7:
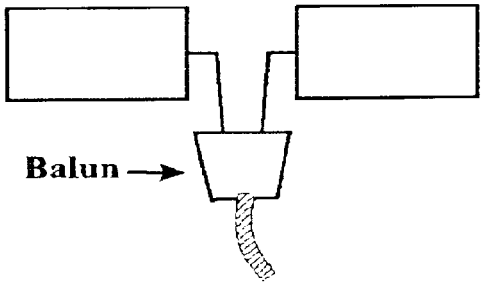
FIG. 7 shows a first embodiment of antenna of the invention with a balum.

FIG.7 provides an example antenna of the invention with a balun. FIG. 7 illustrates a coaxial lead terminating at a balun, the opposing plates of the dipole pair are electrically connected to the separate balun polarities. A balun may be used to ensure correct antenna impedance matching with a transmitter/receiver, and/or to ensure impedance is stabilized again possible external features, such as proximate metal objects, that may otherwise alter antenna impedance characteristics.

The foregoing describes the invention including preferred forms thereof. Alterations and modifications as will be obvious to those skilled in the art are intended to be incorporated within the scope hereof as defined in the accompanying claims.

What is claimed is:

1. A plate dipole antenna including a pair of plates, as defined herein, arranged in substantially the same plane, with a width to length ratio of greater than one width unit to ten length units.

2. A plate dipole antenna according to claim 1 further including a distance of separation between the plates of at least 10% of the length of one of the plates.

3. A plate dipole antenna according to claim 1 or claim 2 further including a gain plate.

4. A plate dipole antenna according to any one of claims 1 to 3 wherein the plates have a substantially flat surface.

5. A plate dipole antenna according to any one of claims 1 to 3 wherein the surface of at least one plate is curved.

6. A plate dipole antenna according to any one of claims 1 to 3 wherein the surface of at least one plate includes at least one fold.

7. A plate dipole antenna according to any one of claims 1 to 3 wherein the surface of at least one plate include at least one discontinuity.

8. A plate dipole antenna according to any one of claims 1 to 7 further including at least one additional pair of plates.

9. A plate dipole antenna according to any one of claims 1 to 8 further including other dipole devices or attachments.

10. A plate dipole antenna according to any one of claims 1 to 9 further including a balun.

11. A plate dipole antenna including at least one pair of plates arranged in different planes with a length to width ratio of greater than one width unit to ten length units.

12. A plate dipole antenna according to claim 11 wherein one plate is arranged substantially perpendicular to the other.

13. A plate dipole antenna according to claim 11 or claim 12 wherein the smaller angle between the plates is greater than 90 degrees.

14. A plate dipole antenna according to any one of claims 11 to 13 further including a gain plate.

15. A plate dipole antenna according to any one of claims 11 to 14 further including a distance of separation between the plates of greater than 5% of the length of one of the plates.

16. A plate dipole antenna according any one of claims 11 to 15 wherein the plates have a substantially flat surface.

17. A plate dipole antenna according to any one of claims 11 to 15 wherein the surface of at least one plate is curved.

18. A plate dipole antenna according to any one of claims 11 to 15 wherein the surface of at least one plate includes at least one fold.

19. A plate dipole antenna according to any one of claims 11 to 15 wherein the surface of at least one plate includes at least one discontinuity.

20. A plate dipole antenna according to any one of claims 11 to 19 further including at least one additional pair of plates.

21. A plate dipole antenna according to any one of claims 11 to 20 further including other dipoles devices or attachments.

22. A plate dipole antenna according to any one of claims 11 to 21 further including a balun.

* * * * *